US008470133B2

(12) United States Patent
Cunnane et al.

(10) Patent No.: US 8,470,133 B2
(45) Date of Patent: Jun. 25, 2013

(54) BELT FOR A MACHINE FOR THE PRODUCTION OF A FIBROUS WEB, PARTICULARLY PAPER OR CARDBOARD, AND METHOD FOR THE PRODUCTION OF SUCH A BELT

(75) Inventors: Francis J. Cunnane, Mt. Pleasant, SC (US); John Jeffery, Blackburn (GB); Danilo Oyakawa, Sao Paulo (BR); Lippi A. Fernandes, Brummen (NL)

(73) Assignee: Voith Patent GmbH, Heidenheim (DE)

( * ) Notice: Subject to any disclaimer, the term of this patent is extended or adjusted under 35 U.S.C. 154(b) by 523 days.

(21) Appl. No.: 12/689,103

(22) Filed: Jan. 18, 2010

(65) Prior Publication Data

US 2010/0137089 A1 Jun. 3, 2010

Related U.S. Application Data

(63) Continuation of application No. PCT/EP2008/055222, filed on Apr. 29, 2008.

(30) Foreign Application Priority Data

Jul. 18, 2007 (DE) ..... 10 2007 033 393

(51) Int. Cl.

| | |
|---|---|
| ***D21F 1/10*** | (2006.01) |
| ***B05D 1/36*** | (2006.01) |
| ***B32B 3/10*** | (2006.01) |

(52) U.S. Cl.

USPC ..... 162/296; 162/348; 162/361; 162/903; 428/196; 427/288; 427/412

(58) Field of Classification Search

USPC ..... 162/116, 117, 348, 358.2, 900–904, 162/361, 362, 109–113, 296; 428/195, 196; 427/288, 412

See application file for complete search history.

(56) References Cited

U.S. PATENT DOCUMENTS

| | | | | |
|---|---|---|---|---|
| 6,149,849 | A * | 11/2000 | Ampulski | 264/167 |
| 6,358,030 | B1 | 3/2002 | Ampulski | |
| 6,610,173 | B1 | 8/2003 | Lindsay et al. | |
| 2005/0167062 | A1 * | 8/2005 | Herman et al. | 162/115 |
| 2006/0182936 | A1 | 8/2006 | Payne et al. | |
| 2007/0170610 | A1 | 7/2007 | Payne et al. | |

FOREIGN PATENT DOCUMENTS

| | | | |
|---|---|---|---|
| DE | 102005033066 | A1 | 1/2007 |
| EP | 1690981 | A1 | 8/2006 |

* cited by examiner

*Primary Examiner* — Eric Hug
(74) *Attorney, Agent, or Firm* — Taylor IP, P.C.

(57) ABSTRACT

A belt for a machine for the production of a fibrous web, in particular paper or cardboard, the belt including a carrier structure, a first material which forms a first pattern on at least one side of the carrier structure such that a portion of the carrier structure remaining exposed, and a second material which forms a second pattern, the second pattern being applied onto the first pattern, wherein the second pattern is completely disposed within the first pattern and a method for producing same.

6 Claims, 2 Drawing Sheets

BELT FOR A MACHINE FOR THE PRODUCTION OF A FIBROUS WEB, PARTICULARLY PAPER OR CARDBOARD, AND METHOD FOR THE PRODUCTION OF SUCH A BELT

CROSS REFERENCE TO RELATED APPLICATIONS

This is a continuation of PCT application No. PCT/EP2008/055222, entitled "BAND FOR A MACHINE FOR THE PRODUCTION OF WEB MATERIAL, PARTICULARLY PAPER OR CARDBOARD, AND METHOD FOR THE PRODUCTION OF SUCH A BAND", filed Apr. 29, 2008, which is incorporated herein by reference.

BACKGROUND OF THE INVENTION

1. Field of the Invention

The present invention relates to a belt for a machine for the production of a fibrous web, in particular paper or cardboard, and to a method for the production of such a belt.

2. Description of the Related Art

A belt, which can be employed as the fabric of a paper machine, for example, a forming sieve or a molding sieve, is known from EP 1 690 981 A1. A sieve printing process using a rotating sieve is used to apply a polymer material onto the carrier structure to form a pattern on the known fabric, for example a woven fabric, of a paper machine. The pattern can be applied in a generally arbitrary structure onto the carrier web in order to generate a structured surface on one side of the fabric, which then produces a corresponding topography on the paper being produced with this machine during the paper production.

EP 1 690 981 A1 describes a process for the application of a pattern onto the fabric of a paper machine, whereby a polymer material used to form the pattern is dispensed in an extrusion process from an extrusion head and applied onto the surface of, for example, a woven fabric for the carrier structure. The extrusion head can, in this case, be moved however necessary across the surface of the carrier structure.

From DE 102005033066 A1 a belt for a paper machine is known, whereby two layers of materials are printed one on top of the other onto a porous carrier structure, for example a woven structure, and where the materials are printed in the form of patterns such that the second layer, in this case the upper pattern which is further away from the carrier structure, exposes in some areas the pattern of the lower layer of material. This creates areas on the carrier structure where the lower layer of material exposes parts of the surface of the carrier structure, which are at least partially covered by the second or upper layer of material, so that a kind of valve effect is achieved, which allows liquid to be drained through the two layers into the porous body of the carrier structure, but which at the same time prevents most of the back flow of the liquid.

What is needed in the art is a belt for a machine to produce a fibrous web, in particular paper or cardboard, with which the structure of the belt is improved, as well as a method to produce such a belt.

SUMMARY OF THE INVENTION

The present invention provides a belt for a machine to produce a fibrous web, in particular paper or cardboard, including a carrier structure covered with a layer of one material having a pattern on at least one side of the carrier structure, which exposes a substantial portion of the carrier structure, as well as another pattern made out of a second material, which is applied onto the pattern of the first material, and which is completely disposed within the confines of the pattern of the first material.

The belt according to the present invention employs two layers of materials that are configured in such a way that the second layer of material, or the upper layer, is disposed entirely within the confines of the pattern that shapes the lower layer of material in order to obtain a very specifically structured topography. By employing these two layers on top of one another, and by precisely controlling the generated topography, it is possible to obtain protrusions that stand particularly high above the surface of the carrier structure. This results on a correspondingly stronger structure of the produced fibrous web based on the topography, formed on the belt.

The carrier structure can be porous to allow fluids to drain through the belt and away from the fibrous web. A carrier structure that is porous further allows a first material that is applied onto the carrier structure to be partially absorbed into the structure of the carrier structure. This creates a very strong connection between the carrier structure and the first material, which in turn constitutes the foundation onto which the pattern of the second material is applied. The pattern of the second layer of material may partially expose the pattern of the first layer of material, but may also be partially congruent in other areas.

The material of the first layer and the material of the second layer may be identical or may differ, for example, in aspects such as hardness or in their surface properties, respectively. The first material and/or the second material may be polymer materials, for example, polyurethane, and the first material and/or the second material may be applied by use of a printing process or by an extrusion process.

The carrier structure may be produced in a number of very different ways. The carrier structure may, for example, consist of a woven fabric, a non-woven fabric, a felt-like fabric or a spiral-link structure. In a carrier structure of this kind it is common to employ a plurality of yarn elements, wound in a threaded fashion, which generally extend in the cross direction of the paper machine, and which are assembled to a chain-like overall structure by overlapping the ends of these yarn elements and inserting long extending, wire-like elements to tie them together.

According to another aspect of the present invention, there is provided a method to produce a belt for a machine for the production of a fibrous web, for example, paper or cardboard, which includes the following steps:

a) providing of a carrier structure;

b) in a first application procedure, the application of a pattern of a first material onto the carrier structure, c) in a second application procedure, the application of a pattern of a second material onto the pattern of the first material such that the second pattern is completely disposed within the confines of the pattern of the first material.

The patterns referred to in the proposed measures b) or/and c) can be applied, for example, by the process of printing or by extrusion.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
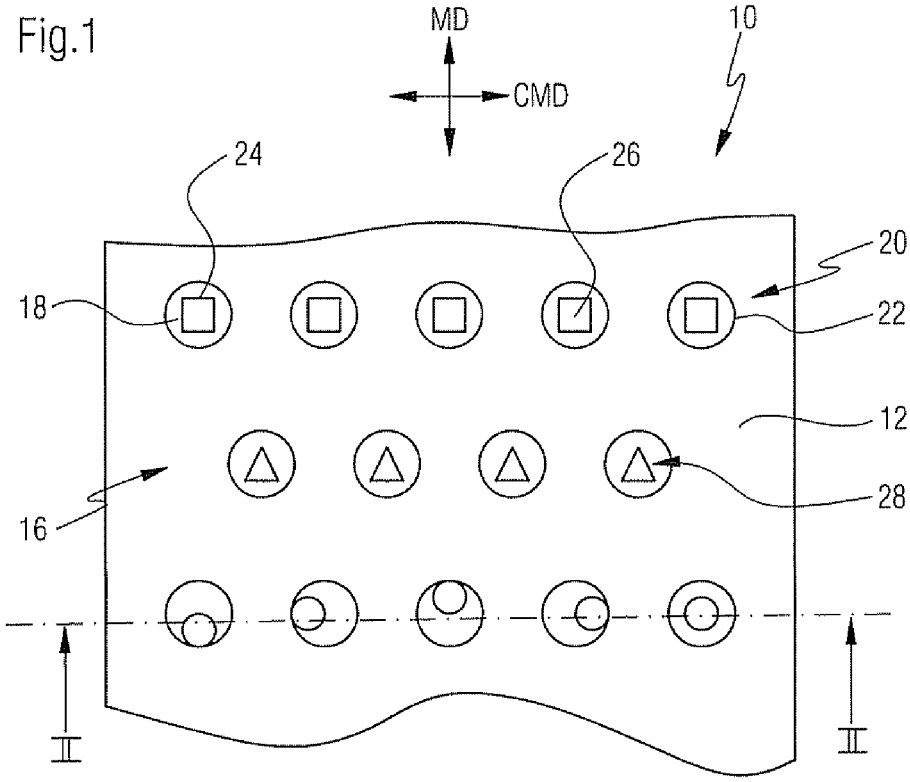
FIG. 1 is a top view of a partial section of a belt for the production of a fibrous web.

Referring now to the drawings, and more particularly to FIG. 1, there is shown a partial section of a belt according to the present invention for the production of a fibrous web, for example, the fabric of a paper machine in the form of a forming sieve or a molding sieve. The schematic depicts a top view, seen from the side that during the manufacturing process contacts the fibrous web to be produced.

Belt 10 includes carrier structure 12, which extends along the machine direction, and which is either provided as a continuous belt or which includes end pieces that can be connected along a machine direction MD in order to form a continuous belt. Carrier structure 12 may have a porous structure, for example a woven fabric, a non-woven fabric, a felt-like fabric or a spiral-link structure, so that any fluids may drain through belt 10 and carrier structure 12 and away from the fibrous web that is to be produced.

Figure 2:
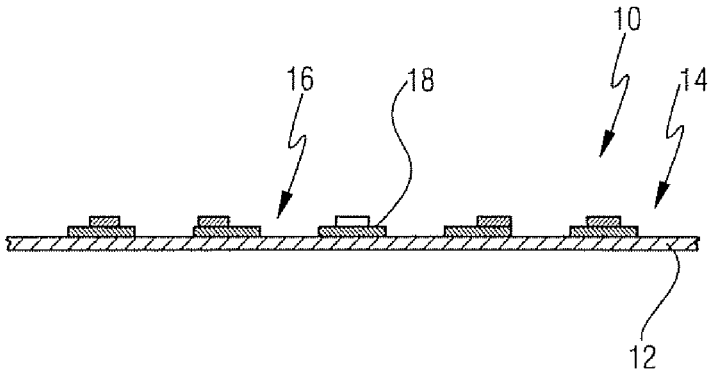
FIG. 2 is a section of the belt depicted in FIG. 1, cut along the line II-III in FIG. 1.

The side of belt 10, viewed in FIG. 1, which appears as upper side 14 of belt 10 in FIG. 2, comes in contact with the fibrous web while carrier structure 12 is partially covered by pattern 16 made out of first material 18. Pattern 16, which is recognizable in FIG. 1, made out of first material 18, consists of rows 20 of circular regions 22, where rows 20 follow one another along the longitudinal direction of the MD, that for the most part extend along the cross direction of the machine CMD. Circular regions 22 may, for example, be applied onto carrier structure 12 by use of a printing process or an extrusion process of a polymer material, for example, polyurethane.

Onto each material region 22 of first material 18, which in their collective entirety constitute pattern 16, second material region 24 is applied of second material 26. Material regions 24 of second material 26 constitute in their collective entirety second pattern 28 of second material 26. It is readily observable that second pattern 28 is entirely disposed within pattern 16, which means that material regions 24 of second material 26 are situated on material regions 22 of first material 18 such that they do not extend beyond the bounds of the latter.

Just as first material 18 such second material 26 can be a polymer material, for example, a polyurethane, which can be applied onto already present material region 22 by a process of printing or by extrusion. It is, for example, possible before applying material region 24 out of second material 26, meaning before applying pattern 28, to proceed by employing the effect of light, which implies the use of thermal treatment, or by allowing a predetermined time after applying pattern 16 of material 18 to elapse, so that, either way, material regions 24 are applied onto, for the most part, completely hardened material regions 22, which constitutes pattern 16.

By applying patterns 16 and 28, one on top of the other, whereby pattern 28 does not extend beyond confines of pattern 16, neither along the machine direction MD nor along the cross machine direction CMD, it is possible to create a very complex topography on side 14, which in turn is negatively printed into the fibrous web being processed. This web material in its completed condition will present a structuring that approximately corresponds to the negative topography of side 14 of the belt. FIG. 1 illustrates the wide range of possible shapes that can be employed for patterns 16 and 28, respectively. The same wide range of possibilities exists for the shapes and contours of material regions 22 of pattern 16, just as it is illustrated for the material regions 24 of pattern 28. It is furthermore understood that material regions 24 of pattern 28 can be positioned however desirable on top of material regions 22 of pattern 16, which act as supports for material regions 24 of pattern 28. Material regions 24 and 28, as illustrated in two upper rows 20 in FIG. 1, can be centrally positioned on top of material regions 22, but can also be, as illustrated in lower rows 20 in FIG. 1, positioned off center with respect to lower material regions 22, which as an example might position upper material region 24 such that a portion of its outer edge is either aligned at a point or with a wider portion of the outer edge of lower material region 22 as it is visible in four out of the five coupled material regions 22 and 24, respectively in lower row 20 in FIG. 1.

Figure 3:
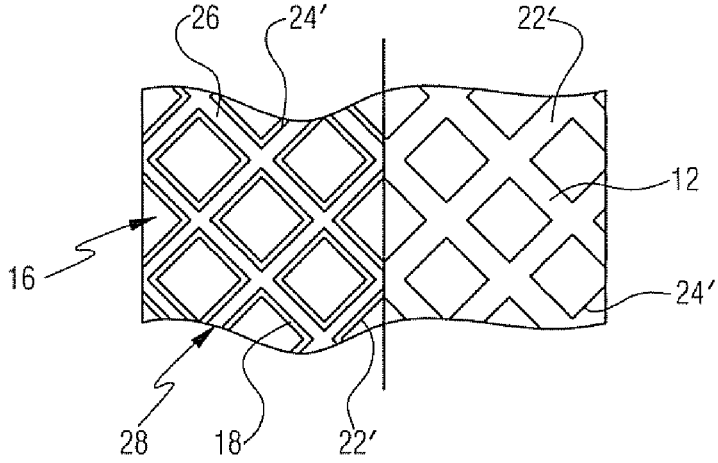
FIG. 3 is a top view corresponding to FIG. 1 of a belt according to the present invention having a different pattern structure.

FIG. 3 illustrates how patterns 16 and 28, respectively can be shaped such that they are not two material regions 22 and 24, which are distinctly different from one another as the ones depicted in FIG. 1, but that similar structures might transcend a continuing pattern, where material regions 22 and 24 are made out of first material 18 and second material 26, respectively. In this context, it is again conceivable, as depicted in the left half of FIG. 3, that second pattern 28 of second material 26 leaves a portion of first pattern 16 of first material 18 exposed, whereby the latter is applied on carrier structure 12. The right half of FIG. 3 depicts a case, where two material regions 22' and 24' and, therefore, also two patterns 16 and 18, are congruent, so that a compound of the two creates an overall volume of the lower pattern that is raised to a comparatively greater height above the surface of carrier structure 12.

Figure 4:
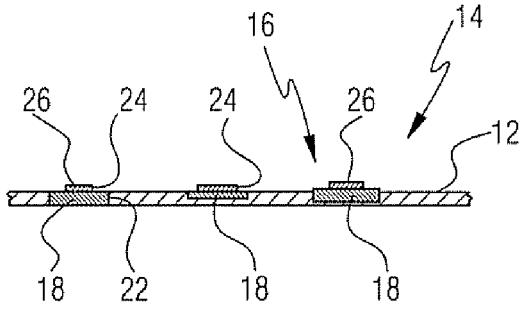
FIG. 4 shows a section of a belt according to the present invention having a different pattern structure of the first material with respect to the carrier structure.

FIG. 4 illustrates how adjusting the level of porosity in carrier structure 12 with respect to the level of viscosity of first material 18 and the manner in which the latter is applied onto the carrier structure can determine the interaction between first material 18 and carrier structure 12. It can, for example, be intended that first material 18 be for the most part completely absorbed into the pore structure of carrier structure 12 as depicted on the left side of FIG. 4. First material 18 may penetrate the entire thickness of carrier structure 12, and it can be applied such that it is substantially not any thicker than carrier structure 12 itself, so that it generally does not protrude above the surface of carrier structure 12. Subsequently, second material 26 can be applied onto lower material regions 22, formed out of first material 18, in order to form upper material regions 24.

The middle portion of FIG. 4 depicts an instant, where material 18 is substantially completely absorbed into carrier structure 12, but where it is not completely penetrating the entire thickness of carrier structure 12. Only a portion of the thickness of carrier structure 12 is penetrated by first material 18, in particular the portion of carrier structure 12 that is closer to side 14, and where first material 18 does not protrude to any significant extent above the surface of carrier structure 12.

The right side of FIG. 4 depicts another instant where first material 18 penetrates only a portion of carrier structure 12 but where first material 18 does extend above the surface of carrier structure 12, so that the presence of first material 18 or the pattern which it forms results in a surface structuring or surface topography, which would produce an imprint in the web material that would be produced with such a belt. It is understood that even in this kind of adaptation first material 18 can be applied in a manner such that it substantially completely penetrates carrier structure 12, as depicted on the left side in FIG. 4. It is furthermore important to point out that the various adaptations for first material 18 depicted in FIG. 4 can be selected without regard to the shapes that are to be patterned on carrier structure 12.

With belt 10 according to the present invention and the method to produce it, it is possible to construct a comparatively complex structuring as well as protrusions that extend comparatively far from the surface of side 14 of belt 10, comes in contact with the fibrous web, and which will leave its imprint in the fibrous web. The way in which the topography is imprinted into the fibrous web, isn't only affected by the height and shape of the patterns, but also by the choice of materials for these patterns. For example, the harder first material 18 or second material 26, the more pronounced and sharply edged the patterns that will be inserted into the fibrous web that is being produced.

The various choices for materials 18 and 26 that are utilized for patterns 16 and 28, can be made such that, for example, the criterion for first material 18 of pattern 16 can be its need to form a very good, strong and stable connection with carrier structure 12, suggesting material 18 needs to be capable of flowing particularly well during its application onto the carrier structure and, thus, penetrate the pore structure of carrier structure 12 as deeply as possible. The choice for second material 26 can be primarily made based on the criterion that it has to leave an imprint in the starting material of the fibrous web that is being produced. It is, therefore, conceivable that second material 26 be selected to have a higher hardness than first material 18. But the opposite is also conceivable, such that first material 18 be selected to have a higher hardness than second material 26.

In conclusion, it is noted that with belt 10 being designed according to the present invention and the method to produce it, it is conceivable that at least one of patterns 16 or 28, respectively, can be varied either along the machine direction MD or along the cross direction of the machine CMD. Accordingly, this also holds true for the materials that are employed to produce the patterns on belt 10, and which need not be the same in all locations of belt 10.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A belt for a machine for the production of a fibrous web, said belt comprising:

a porous carrier structure;

a first material forming a first pattern on at least one side of said carrier structure, a substantial portion of said carrier structure remaining exposed, said first material being at least partially absorbed into a pore structure of said porous carrier structure; and a second material different from said first material forming a second pattern, said second pattern applied onto said first pattern, wherein said second pattern is completely disposed within said first pattern and said second pattern of said second material leaves a portion of said first pattern of said first material exposed, said second pattern of said second material being at least partially congruent with said first pattern of said first material, at least one of said first material and said second material being applied by extrusion.

2. The belt according to claim 1, wherein at least one of said first material and said second material is a polymer material.

3. The belt according to claim 2, wherein said other of said first material and said second material is applied in a printing process.

4. The belt according to claim 1, wherein said carrier structure is one of a woven fabric, a non-woven fabric, a felt fabric, and a spiral-link structure.

5. A belt for a machine for the production of a fibrous web, said belt comprising:

a carrier structure;

a first material forming a first pattern on at least one side of said carrier structure, a substantial portion of said carrier structure remaining exposed; and a second material forming a second pattern, said second pattern applied onto said first pattern, wherein said second pattern is completely disposed within said first pattern, said first material being different from said second material.

6. A method for the production of a belt for a machine for producing a fibrous web, the method including the following steps:

providing a carrier structure;

applying a first pattern of a first material onto said carrier structure; and applying a second pattern of a second material onto said first pattern of said first material such that said second pattern is completely disposed within said first pattern, said first material being different from said second material.

* * * * *